US006682407B2

(12) United States Patent
Tokutake et al.

(10) Patent No.: US 6,682,407 B2
(45) Date of Patent: Jan. 27, 2004

(54) WORK-PIECE PROCESSING MACHINE

(75) Inventors: Hideo Tokutake, Nagano (JP); Takenori Kitazawa, Nagano (JP); Takao Nishina, Nagano (JP); Hiroshi Usuda, Nagano (JP)

(73) Assignee: Kabushiki Kaisha Koyama, Nagano (JP)

( * ) Notice: Subject to any disclaimer, the term of this patent is extended or adjusted under 35 U.S.C. 154(b) by 128 days.

(21) Appl. No.: 09/963,296

(22) Filed: Sep. 26, 2001

(65) Prior Publication Data

US 2002/0168928 A1 Nov. 14, 2002

(30) Foreign Application Priority Data

May 9, 2001 (JP) ..... 2001-138308

(51) Int. Cl.[7] ..... B24B 3/06

(52) U.S. Cl. ..... 451/65; 451/5; 451/194; 451/363; 451/197

(58) Field of Search ..... 451/64–66, 194, 451/195, 197, 199, 204, 363, 5

(56) References Cited

U.S. PATENT DOCUMENTS

| | | | | | |
|---|---|---|---|---|---|
| 4,461,121 | A | * | 7/1984 | Motzer et al. | 451/5 |
| 4,615,150 | A | * | 10/1986 | Panetti | 451/347 |
| 5,618,226 | A | * | 4/1997 | Ueyama | 451/234 |
| 6,179,695 | B1 | * | 1/2001 | Takahashi et al. | 451/287 |
| 6,368,193 | B1 | * | 4/2002 | Carlson et al. | 451/66 |
| 6,435,951 | B1 | * | 8/2002 | Ishizaka | 451/66 |

* cited by examiner

*Primary Examiner*—George Nguyen
(74) *Attorney, Agent, or Firm*—Jordan and Hamburg LLP

(57) ABSTRACT

The work-piece-processing machine of the present invention is compact and has two tools for precisely processing a work-piece. In the work-piece-processing machine, the work-piece is processed by a first tool and a second tool. Diameter of the second tool is shorter than that of the first tool. A first motor rotates the first tool. A second motor rotates the second tool. The first motor and the second motor are attached to a rotatable member. A rotating unit rotates the rotatable member in a vertical plane.

2 Claims, 7 Drawing Sheets

FIG.3
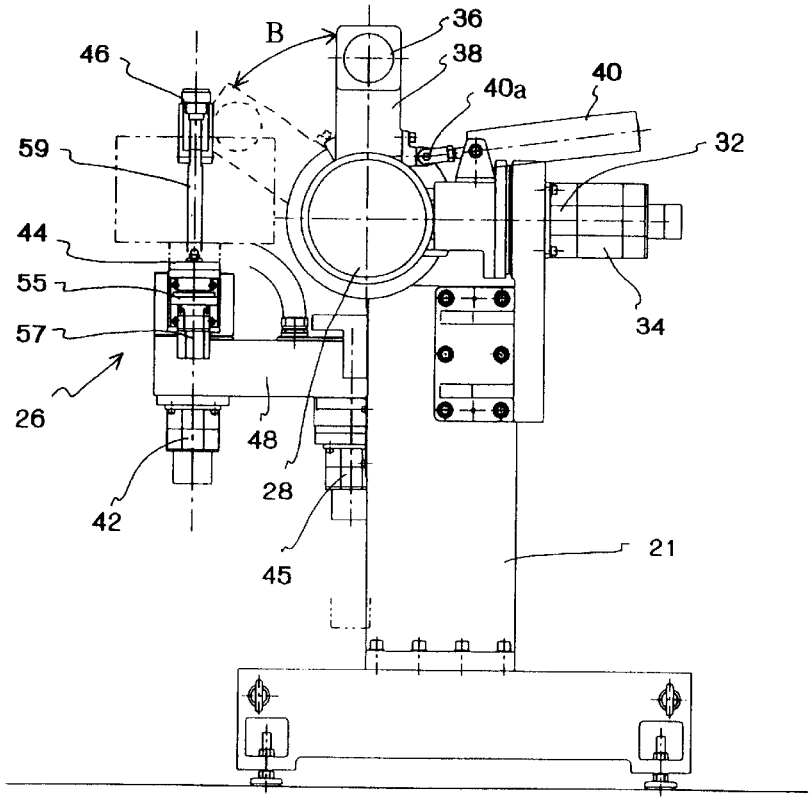
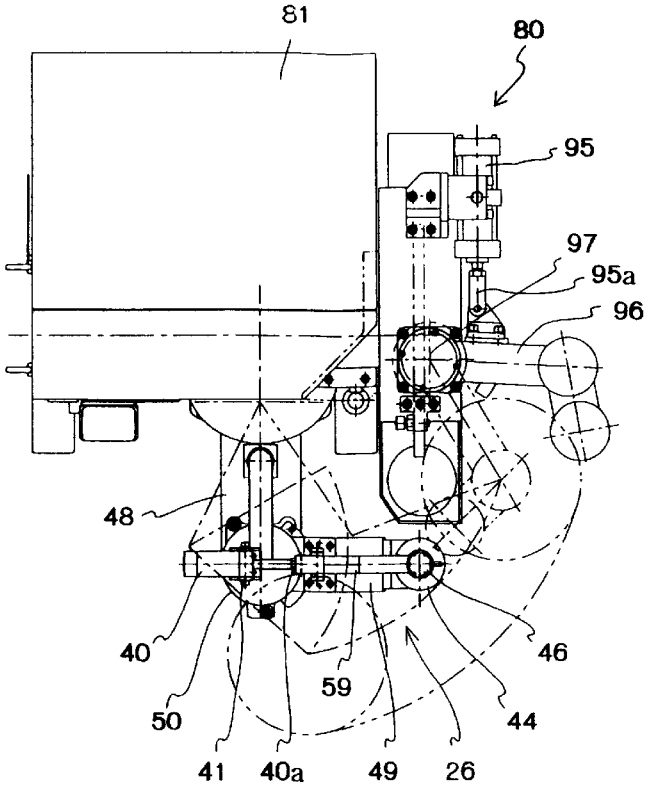
FIG.9

WORK-PIECE PROCESSING MACHINE

BACKGROUND OF THE INVENTION

The present invention relates to a work-piece processing machine, e.g., a deburring machine capable of removing burrs from cast products.

In the case of casting products, gates and burrs must be removed from cast products. To remove gates and burrs, many types of automatic deburring machines have been invented.

One of conventional deburring machines is shown in FIG. 10. FIG. 10 is a plan view of the machine.

The deburring machine 10, which is an example of the work-piece processing machines, includes: a base 11; a work-piece holder 9 capable of holding a cast product 15, which is an example of work-pieces; and two arms 12 and 13 for moving the work-piece holder 9 in a horizontal plane.

A disk-shaped grinding tool 6 is attached to a motor shaft 7 of a motor 8. By driving the motor 8, the grinding tool 6 is rotated about the shaft 7. The shaft 7 is rotatably supported by a bearing 5.

Heading of the shaft 7 of the grinding tool 6 is fixed. To grind (process) various positions of the work-piece 15, the arms 12 and 13 of the work-piece holder 9 are pivoted in the horizontal plane, and the arm 12 is vertically moved by a vertical driving mechanism (not shown), so that the grinding tool 6 can be moved to any positions in the work-piece 15. With this action, the work-piece 15 can be properly ground by the grinding tool 6.

However, if the work-piece 15 has a hole or a complex shape, some parts of the work-piece 15 cannot be ground by the large grinding tool 6.

To solve the problem, another conventional machine (not shown) has a large grinding tool and a small grinding tool.

To grind a work-piece having a complex shape, the small grinding tool is held and moved by an arm as well as the work-piece holder.

However, mechanisms for moving the two grinding tools are complex, so that size of the deburring machine must be larger.

The large grinding tool is projected forward from a base, and the small grinding tool must be further projected so as to grind or process the work-piece. Since the small grinding tool is located in front of the large grinding tool, it is difficult to attach the work-piece to work-piece holder and detach the work-piece therefrom. Namely, the small grinding tool must be located in back of the large grinding tool.

SUMMARY OF THE INVENTION

An object of the present invention is to provide a compact work-piece processing machine having two tools for precisely processing a work-piece.

Another object is to provide a work-piece processing machine, in which a work-piece can be easily attached and detached.

To achieve the objects, a first basic structure of the work-piece processing machine of the present invention comprises:

a first tool;

a second tool whose diameter is shorter than that of the first tool;

a first motor for rotating the first tool;

a second motor for rotating the second tool;

a rotatable member to which the first motor and the second motor are attached; and means for rotating the rotatabe member in a vertical plane.

With this structure, directions of axes of the first tool and the second tool can be changed by one rotating means. Namely, the work-piece can be precisely processed without assembling complex mechanisms.

In the work-piece processing machine, the second tool may be attached to a bearing of a rotary shaft of the first tool, and the second tool may be pivoted on the rotary shaft of the first tool by pivoting means. With this structure, the second tool can be optionally moved by the simple structure. The work-piece can be precisely processed. If the rotary shaft of the first tool is vertically arranged, the second tool can be easily moved between a position near the work-piece and a position in back of the first tool by the simple structure. Therefore, the second tool never obstructs the work-piece when the work-piece is exchanged.

In the work-piece processing machine, a rotary shaft of the first tool may be arranged perpendicular to a motor shaft of the first motor, and a rotary shaft of the second shaft may be arranged parallel to the rotary shaft of the first tool. With this structure, size of the machine in the axial direction of the motor shaft of the first motor can be small if the first motor is a large motor.

A second basic structure of the work-piece-processing machine of the present invention comprises:

a base;

a work-piece holder for holding a work-piece, the work-piece holder being provided to the base;

a first tool;

a second tool whose diameter is shorter than that of the first tool;

a first motor for rotating the first tool;

a second motor for rotating the second tool; and means for moving the second tool between a processing position, which is located in front of the base and at which the work-piece held by the work-piece holder is processed by the first tool and the second tool, and a waiting position, which is located in back of the first tool.

With this structure, the second tool can be moved between the processing position and the waiting position, so the second tool never obstructs the work-piece when the work-piece is exchanged.

The work-piece processing machine may further comprise means for pivoting the second tool in a 45-degree arc with respect to a horizontal plane so as to change an axial line of a rotary shaft of the second tool. With this structure, the second tool can be properly moved to positions of the work-piece to be processed without widely moving the work-piece holder in the vertical direction. Therefore, size of the machine can be smaller.

BRIEF DESCRIPTION OF THE DRAWINGS

Embodiments of the present invention will now be described by way of examples and with reference to the accompanying drawings, in which:

FIG. 3 is a side view of the work-piece-processing machine shown in FIG. 1;

FIG. 9 is a plan view of the work-piece-processing machine shown in FIG. 7.

DETAILED DESCRIPTION OF THE PREFERRED EMBODIMENTS

Preferred embodiments of the present invention will now be described in detail with reference to the accompanying drawings. In the following embodiments, deburring machines, which remove gates and burrs from cast products, will be explained as the work-piece processing machines.

First Embodiment

A first embodiment of the present invention will be explained with reference to FIGS. 1–3.

Figure 1:
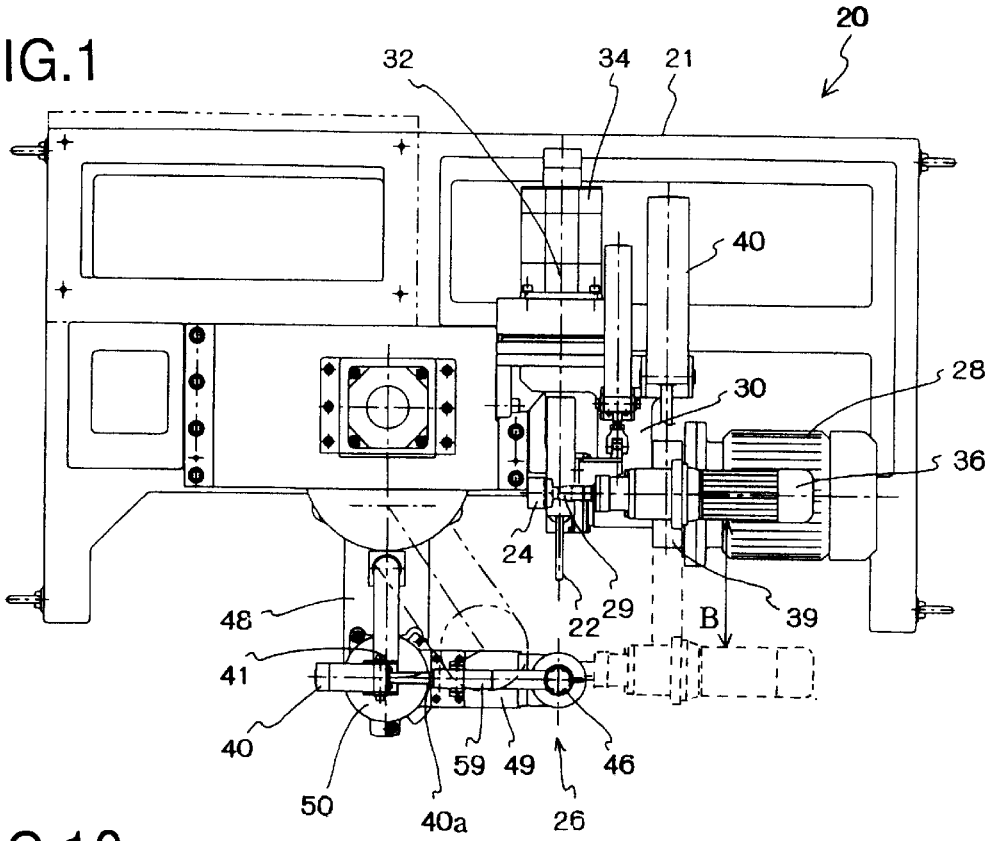
FIG. 1 is a plan view of the work-piece-processing machine of a first embodiment of the present invention.
Figure 10:
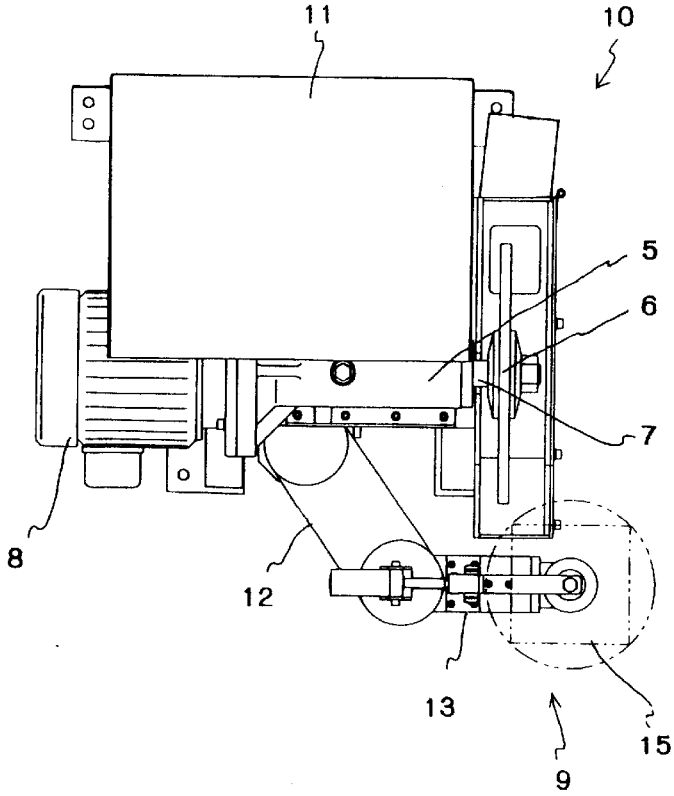
FIG.10 PRIOR ART
FIG. 10 is a side view of the conventional work-piece-processing machine.

FIG. 1 is a plan view of the work-piece processing machine; FIG. 2 is a front view thereof; and FIG. 3 is a side view thereof.

The deburring machine 20 includes: a large disk-shaped grinding tool (rotary grind stone) 22; a small disk-shaped grinding tool (rotary grind stone) 24 whose diameter is shorter than that of the large grinding tool 22; a work-piece holder 26 for holding a cast product (work-piece); and a base 21, on which said members are provided.

The grinding tool 22 is attached to a rotary shaft 23 of the motor 28 and rotated by the motor 28. Note that, a symbol 39 stands for a bearing section of the motor 28.

The motor 28 is attached to the base 21 by a stay (rotatable member) 30. The stay 30 is rotated in a vertical plane by a rotary shaft 32, which is horizontally extended from the base 21. The rotary shaft 32 is connected to a motor (rotating means) 34.

Figure 2:
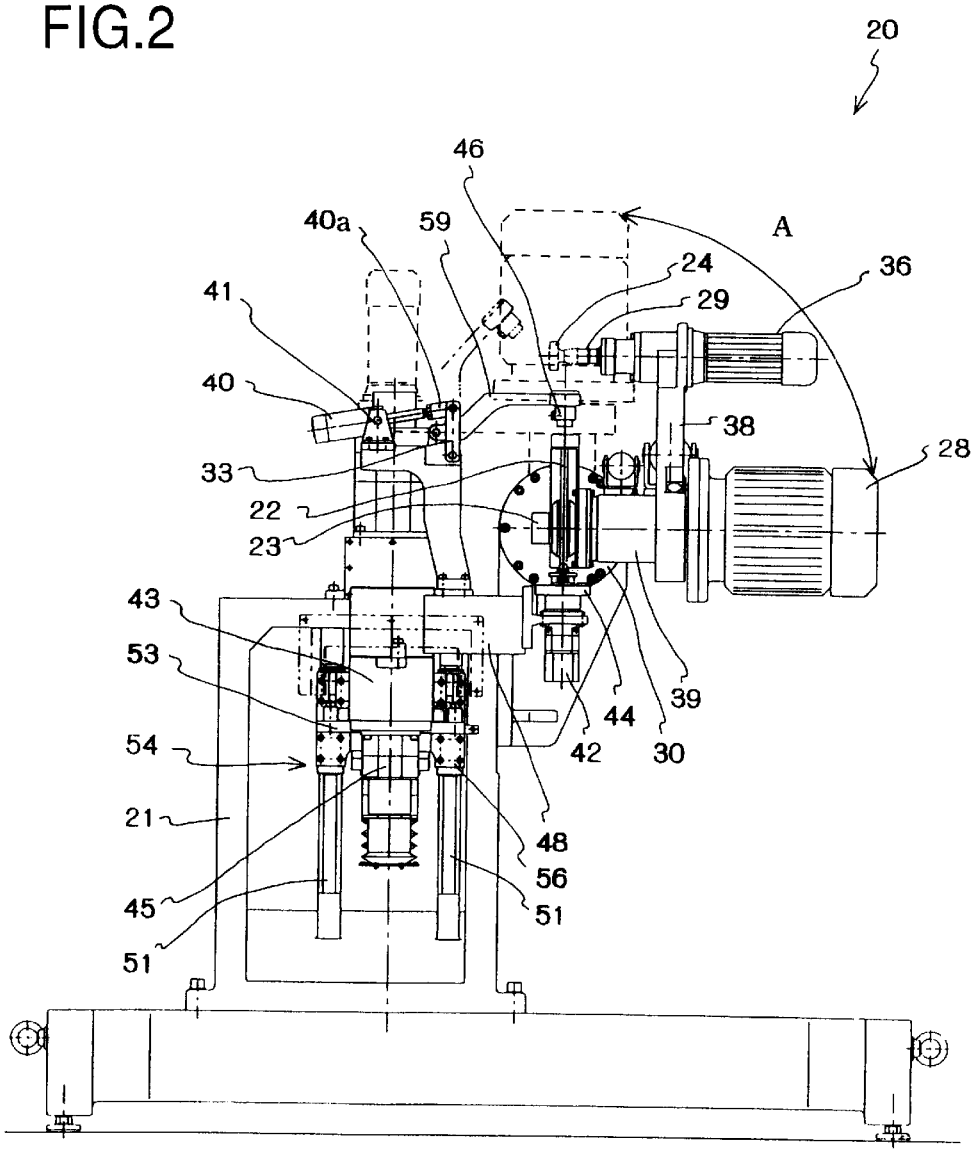
FIG. 2 is a front view of the work-piece-processing machine shown in FIG. 1.

By driving the motor 34, the stay 30 is rotated about the rotary shaft 32, and the grinding tool 22 and the motor 28 are rotated about the rotary shaft 32 in the vertical plane as shown by an arrow "A" of FIG. 2.

With this action, a side face of the grinding tool 22 is capable of moving toward the work-piece in the vertical direction and the horizontal direction.

On the other hand, the small grinding tool 24 is attached to a motor shaft 29 of the motor 36. Therefore, the grinding tool 24 is rotated by the motor 36.

The motor 36 is connected to a bearing 39 of the motor 28 by an arm 38 and capable of rotating about the bearing 39. A rod 40*a* of a cylinder unit 40 is connected to the arm 38. With this structure, the arm 38 is pivoted on the shaft of the motor 28 by extending and retracting the rod 40*a* of the cylinder unit 40. The cylinder unit 40 is pivotably attached to the base 21 by a shaft 31, so that the rod 40*a* can be properly extended from and retracted into the cylinder unit 40.

Since the grinding tool 24 is attached to the bearing 39 of the grinding tool 22, the grinding tool 24 is rotated about the rotary shaft 32, in the direction of the arrow "A" of FIG. 2, together with the grinding tool 22 by pivot action of the stay 30, further the grinding tool 24 is rotated about the shaft 23 of the motor 28 in a direction shown by an arrow "B" of FIGS. 1 and 3.

With this action, the small grinding tool 24 is capable of moving to and contacting various positions or parts of the work-piece, so that the grinding tool 24 can precisely grind or process an inner face of a hole of the work-piece and complex parts thereof.

The grinding tools 22 and 24 are moved by the common mechanism, size of the deburring machine can be smaller.

When the shaft 29 of the motor 36 is arranged in the vertical direction, the grinding tool 24 is rotated about the shaft 29, so the grinding tool 24 is capable of moving between a processing position, at which the work-piece is processed, and a waiting position, which is located on the base 21 side.

With this structure, the grinding tool 24 never obstructs the work-piece when the work-piece is attached and detached.

The work-piece holder 26 includes: a lower clamping member 44 on which the work-piece is rotatably mounted; and an upper clamping member 46 capable of vertically clamping the work-piece with the lower clamping member 44. Further, the work-piece holder 26 includes: a base arm 48 and a front arm 49, which are mutually connected by a joint. The base arm 48 is located in front of the base 21 and attached thereto. The base arm 48 is capable of pivoting in a horizontal plane.

A base end of the base arm 48 is connected to a motor shaft (not shown) of a motor 45, which is provided in the base 21. The motor shaft is pierced through a bearing 43 and projected upward. The projected part is connected to the base arm 48. With this structure, the base arm 48 is pivoted, about the shaft, in a horizontal plane by the motor 45.

The motor 45 is attached to a vertical driving mechanism 54 by a stay 53.

The vertical driving mechanism 54 includes: vertical guides 51; sliding members 56, which are respectively slidably attached to the vertical guides 51; and a ball screw (not shown) for vertically moving the stay 53.

By spinning the ball screw (not shown), the vertical driving mechanism 54 vertically moves the stay 53 along the guides 51. By the vertical movement of the stay 53, the base arm 48 is moved in the vertical direction, so that the work-piece held by the work-piece holder 26 can be moved in the vertical direction.

A motor 42 is attached on a bottom face of a front end section of the base arm 48. A motor shaft (not shown) of the motor 42 is pierced through the base arm 48, and its front end is fixed to the front arm 49. With this structure, the front arm 49 is pivoted in a horizontal plane by the motor 42.

A stay 55 is attached to a front end of the front arm 49. A motor 57 is attached on a bottom face of the stay 55.

A motor shaft (not shown) of the motor 57 is pierced through the stay 55 and attached to the lower clamping member 44. Therefore, the motor 57 rotates the lower clamping member 44 so as to rotate the work-piece in a horizontal plane.

The upper clamping member 46 is attached to a front end of a lever 59. A base end of the lever 59 is pivotably attached to a link section 33. An upper end of the link section 33 is pivotably connected to a front end of the rod 40*a* of the cylinder unit 40. The cylinder unit 40 is pivotably attached to a shaft 41. With this structure, the link section 33 is actuated by extending and retracting the rod 40*a*, so that the link section 33 pivots the lever 59.

When the upper clamping member 46 is moved away from the lower clamping member 44 by the cylinder unit 40, the work-piece can be attached and detached.

Second Embodiment

A second embodiment of the present invention will be explained with reference to FIGS. 4–6. Note that, the structural elements explained in the first embodiment are assigned the same symbols and explanation will be omitted.

Figure 4:
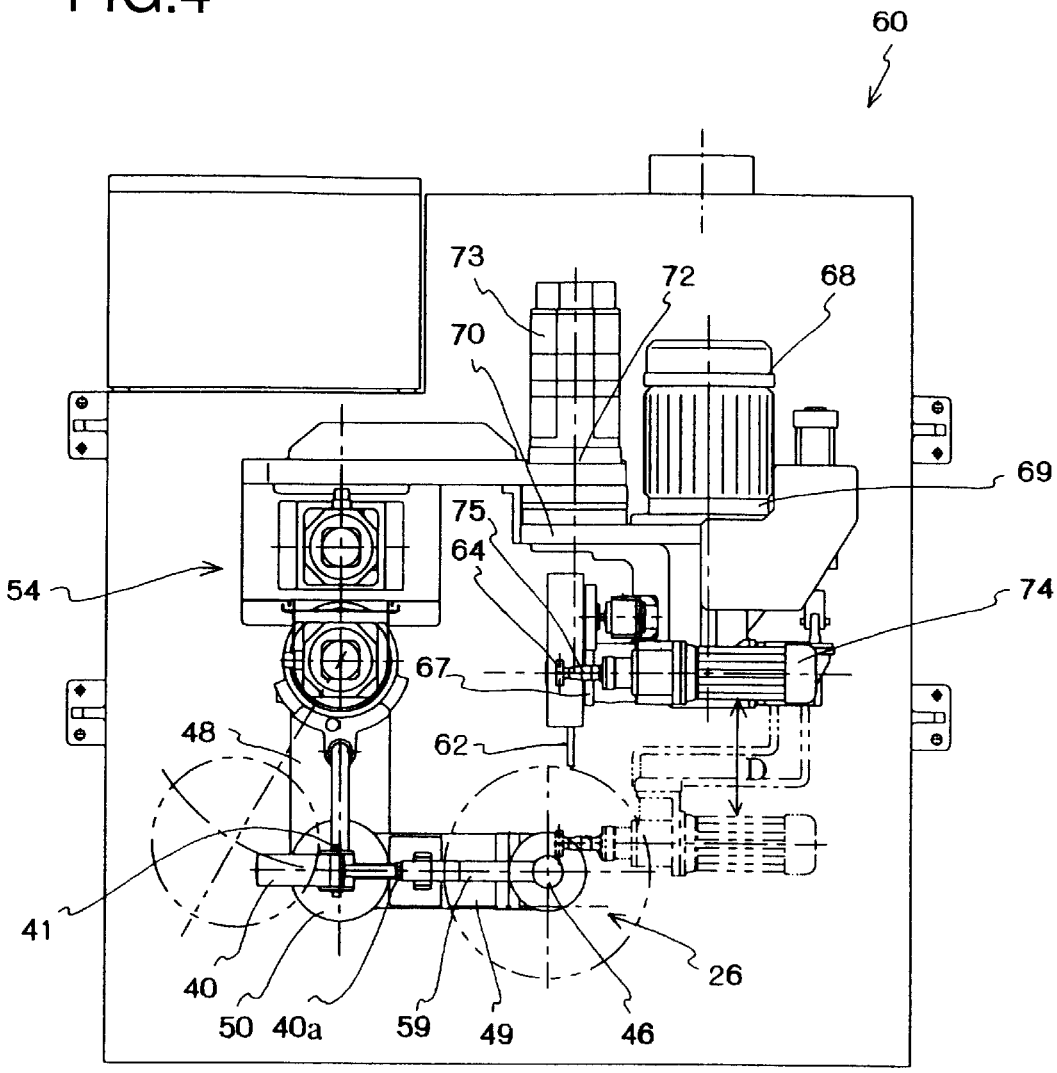
FIG. 4 is a plan view of the work-piece-processing machine of a second embodiment of the present invention.

FIG. 4 is a plan view of the work-piece-processing machine; FIG. 5 is a front view thereof; and FIG. 6 is a side view thereof.

The work-piece processing machine (deburring machine) 60 includes: a large disk-shaped grinding tool (rotary grindstone) 62; and a small disk-shaped grinding tool (rotary grindstone) 64, whose diameter is shorter than that of the large grinding tool 62, as well as the first embodiment.

The grinding tool 62 is attached to an output shaft 67, from which torque of a motor 68 is outputted. Namely, the grinding tool 62 is rotated by the motor 68. The output shaft 67 is connected to the motor 68 by connecting means, e.g., bevel gears. The shaft 67 of the grinding tool 62 is arranged perpendicular to a motor shaft (not shown) of the motor 68.

A stay 70, which is extended from a base 61, is attached to a bearing 69 of the motor 68.

A motor shaft 72 of a motor 73 is attached to a base end of the stay 70, which is connected to the base 61. By driving the motor 73, the stay 70 is pivoted on the shaft 72, so that the grinding tool 62 and the motor 68 are pivoted, on the shaft 72, in a vertical plane as shown by an arrow "C" of FIG. 5.

With this structure, a side face of the grinding tool 62 is capable of moving toward the work-piece in the vertical direction and the horizontal direction.

On the other hand, the small grinding tool 64 is attached to a motor shaft 75 of a motor 74. Therefore, the grinding tool 64 is rotated by the motor 74.

The motor 74 is attached to one end of a bearing 65 of a rotary shaft 67 of the grinding tool 62 by an arm 76. The motor 74 can be pivoted on the shaft 67. The arm 76 is pivoted on the shaft 67 of the grinding tool 62 by a motor (not shown).

Figure 5:
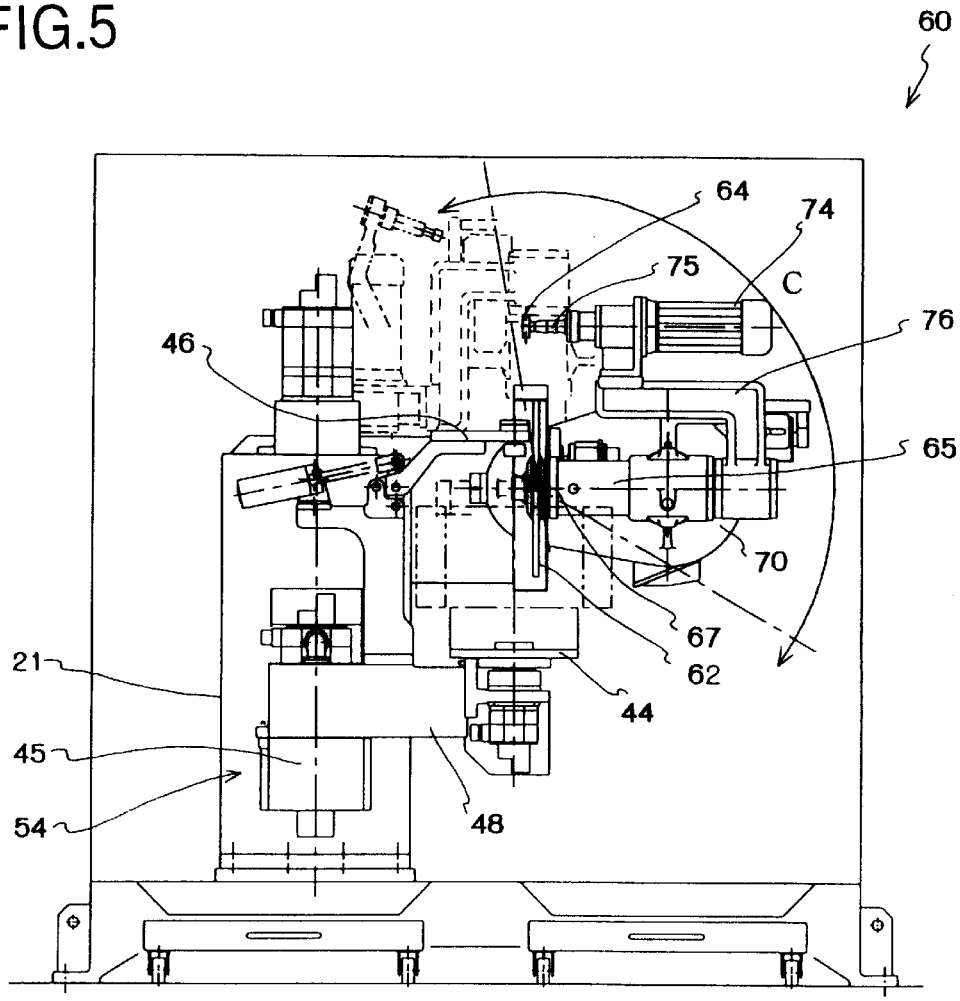
FIG. 5 is a front view of the work-piece-processing machine shown in FIG. 4.
Figure 6:
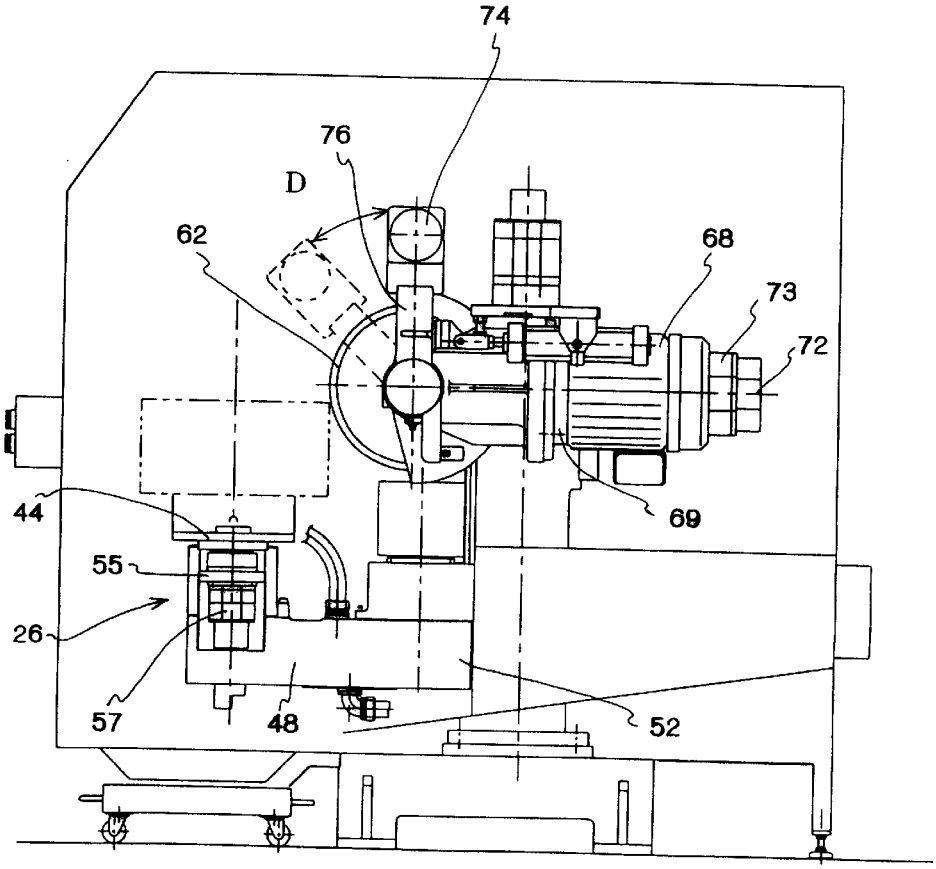
FIG. 6 is a side view of the work-piece-processing machine shown in FIG. 4.

With this structure, the grinding tool 64 is rotated about the rotary shaft 72 in the direction of the arrow "C" of FIG. 5, together with the grinding tool 22, by pivot action of the stay 70, further the grinding tool 64 is rotated about the shaft 67 of the grinding tool 62 in a direction shown by an arrow "D" of FIGS. 4 and 6.

With this action, the small grinding tool 64 is capable of moving to and contacting various positions or parts of the work-piece, so that the grinding tool 64 can precisely grind or process an inner face of a hole of the work-piece and complex parts thereof.

When the shaft 67 of the grinding tool 62 is arranged in the vertical direction, the grinding tool 64 is rotated about the shaft 67, so the grinding tool 24 is capable of moving between a processing position, at which the work-piece is processed, and a waiting position, which is located on the base 61 side.

With this structure, the grinding tool 64 never obstructs the work-piece when the work-piece is attached and detached.

Means for vertically moving the work-piece holder 26 is not shown, but the work-piece 26 can be vertically moved as well as the first embodiment.

Third Embodiment

A third embodiment of the present invention will be explained with reference to FIGS. 7–9. Note that, the structural elements explained in the foregoing embodiments are assigned the same symbols and explanation will be omitted.

Figure 7:
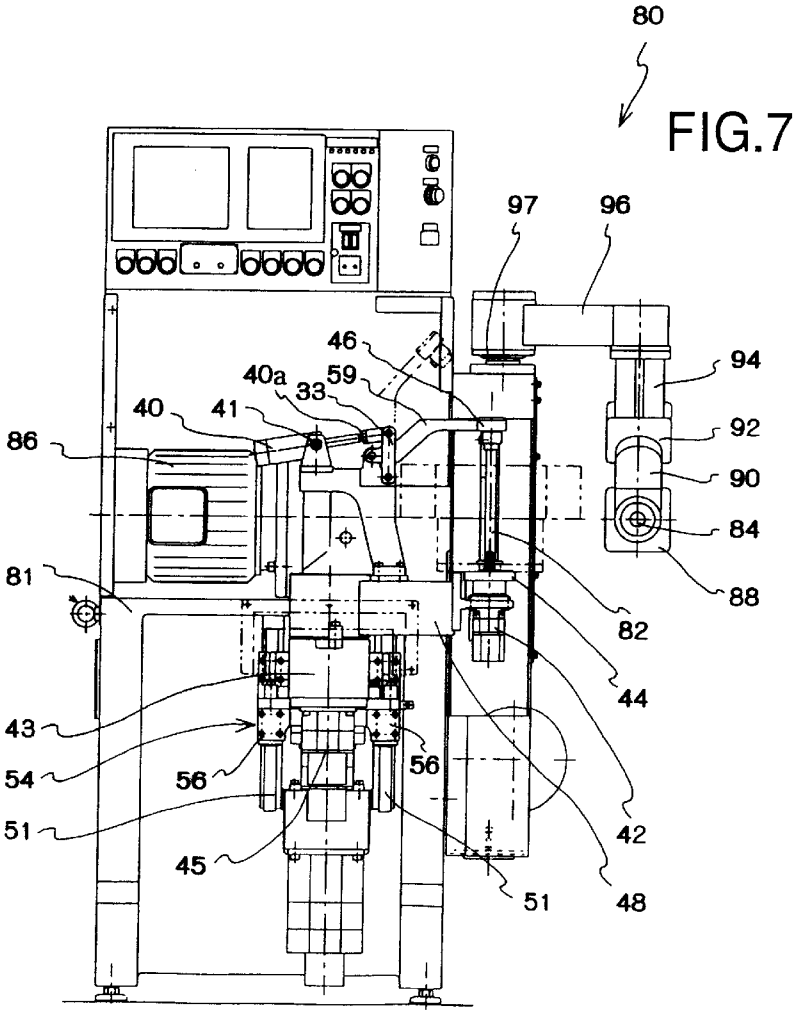
FIG. 7 is a front view of the work-piece-processing machine of a third embodiment of the present invention.

FIG. 7 is a front view of the work-piece processing machine; FIG. 8 is a side view thereof; and FIG. 9 is a plan view thereof.

The work-piece processing machine (deburring machine) 80 includes: a large disk-shaped grinding tool (rotary grindstone) 82; and a small disk-shaped grinding tool (rotary grindstone) 84, whose diameter is shorter than that of the large grinding tool 82, as well as the first and second embodiments.

The grinding tool 82 is attached to a motor shaft (not shown) of a motor 86. Namely, the grinding tool 82 is rotated by the motor 86.

Unlike the first and second embodiments, the grinding tool 62 is not pivoted, so side faces of the grinding tool 62 are arranged in the vertical direction only.

The small grinding tool 84 is attached to a motor shaft 85 of a motor 88, so the grinding tool 84 is rotated by the motor 88.

The motor 88 is pivotably attached to a motor shaft 90 of a motor 92 by an arm 89.

The shaft 90 is inclined 45° with respect to a horizontal plane. The arm 89 is arranged perpendicular to the shaft 90. The motor 88 is diagonally attached to the arm with angle of 45°.

Figure 8:
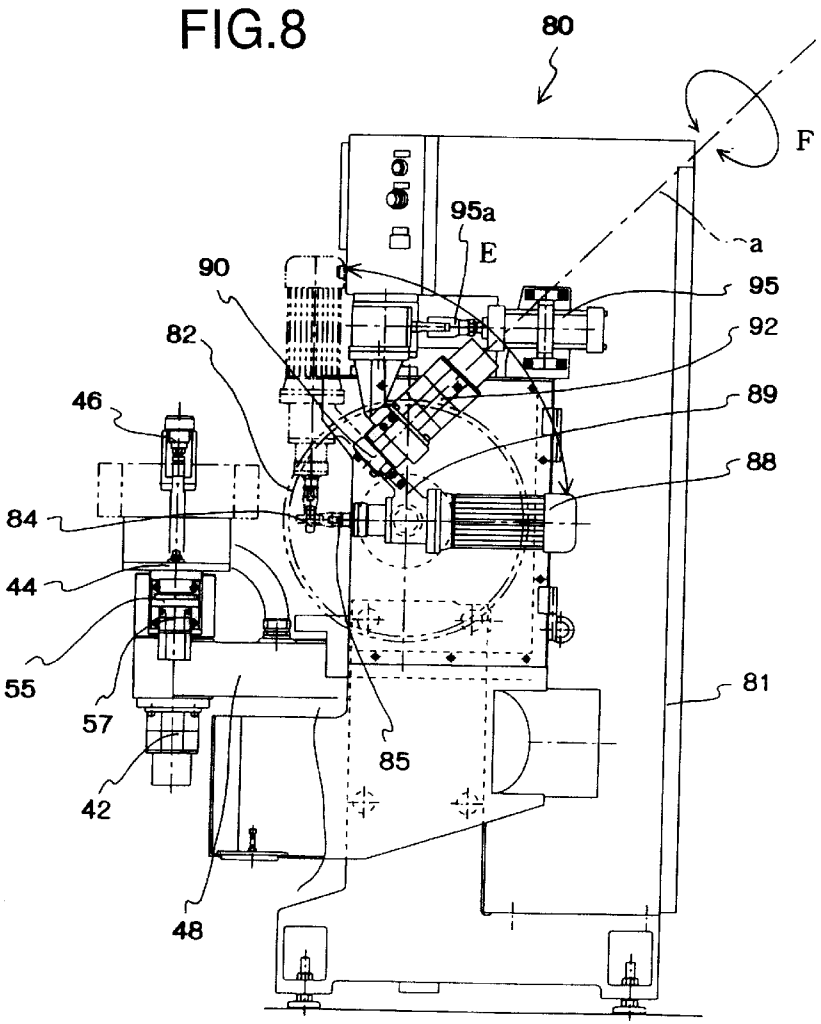
FIG. 8 is a side view of the work-piece-processing machine shown in FIG. 7.

By pivoting the arm 89 on the shaft 90, the grinding tool 84 is pivoted between a first position, at which the shaft 85 of the motor 88 is horizontally arranged, and a second position, at which the shaft 85 is vertically arranged (see an arrow "E" of FIG. 8).

In FIG. 8, the arm 89 is pivoted, on an axial line "a", in a direction of an arrow "F" by the motor 92. Then the grinding tool 84 is pivoted on the shaft 90. The grinding tool 84 is capable of contacting the work-piece while the shaft 85 of the grinding tool 84 is moved from the horizontal state to the vertical state.

The motor 92 is pivoted, in the horizontal plane, with respect to the base 81 by arms 94 and 96. The arm 96 is pivotably attached to a vertical shaft 97 of the base 81. A front end of a rod 95*a* of a cylinder unit 95 is pivotably connected to a mid part of the arm 96. The cylinder unit 95 is fixed to the base 81, and the rod 95*a* is extended in the horizontal direction. With this structure, the arm 96 can be pivoted on the shaft 97 by extending and retracting the rod 95*a*.

The arm 94 is attached to a bottom face of a front end section of the arm 96. The arm 94 is extended downward. The motor 92 is fixed to a lower end of the arm 94.

Note that, the arm 94 may be pivoted in a horizontal plane with respect to the arm 96.

In the present embodiment too, the grinding tool 84 can be moved between the processing position, at which the work-piece is ground or processed, and the waiting position, which is located rear side, so the grinding tool 84 never obstructs the work-piece when the work-piece is attached and detached.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A work-piece processing machine, comprising:

a first tool;

a second tool whose diameter is shorter than that of said first tool;

a first motor for rotating said first tool;

a second motor for rotating said second tool;

a rotatable member to which said first motor and said second motor are attached; and means for rotating said rotatable member in a vertical plane, wherein said second tool is attached to a bearing of a rotary shaft of said first tool, and said second tool is pivoted on the rotary shaft of said first tool by pivoting means.

2. A work-piece processing machine, comprising:

a base;

a work-piece holder for holding a work-piece, said work-piece holder being provided to said base;

a first tool;

a second tool whose diameter is shorter than that of said first tool;

a first motor for rotating said first tool;

a second motor for rotating said second tool; and means for moving said second tool between a processing position, which is located in front of said base and at which the work-piece held by said work-piece holder is processed by said first tool and said second tool, and a waiting position, which is located on the base side with respect to the processing position.

* * * * *